US006070620A

United States Patent [19]

Wiemeler

[11] Patent Number: 6,070,620

[45] Date of Patent: Jun. 6, 2000

[54] SLIDING BAR TEMPLE FOR A POWER LOOM

[75] Inventor: Klemens Wiemeler, Greven, Germany

[73] Assignee: Sulzer Rueti AG, Rueti, Switzerland

[21] Appl. No.: 09/125,176

[22] PCT Filed: Dec. 19, 1997

[86] PCT No.: PCT/IB97/01617

§ 371 Date: Aug. 12, 1998

§ 102(e) Date: Aug. 12, 1998

[87] PCT Pub. No.: WO98/28475

PCT Pub. Date: Jul. 2, 1998

[30] Foreign Application Priority Data

Dec. 23, 1996 [DE] Germany ..... 196 54 039

[51] Int. Cl.[7] ..... D03J 1/22

[52] U.S. Cl. ..... 139/294; 26/78

[58] Field of Search ..... 139/294, 295, 139/297, 299, 300, 301, 298; 26/78, 105

[56] References Cited

U.S. PATENT DOCUMENTS

| | | | |
|---|---|---|---|
| 2,042,415 | 5/1936 | Stimpson et al. | 139/295 |
| 4,919,171 | 4/1990 | Dornier | 139/292 |
| 4,951,717 | 8/1990 | Riezler | 139/294 |
| 5,052,447 | 10/1991 | Speich | 139/294 |
| 5,305,803 | 4/1994 | Steinberger | 139/291 R |

FOREIGN PATENT DOCUMENTS

| | | |
|---|---|---|
| 0 336 409 A2 | 10/1989 | European Pat. Off. . |
| 0 557 724 A1 | 9/1993 | European Pat. Off. . |
| 1.522.148 | 4/1968 | France . |
| 495300 | 3/1930 | Germany . |

*Primary Examiner*—Andy Falik

*Attorney, Agent, or Firm*—Townsend and Townsend and Crew LLP

[57] ABSTRACT

The bar type temple (2) consists substantially of a bar carrier (23), a working bar (3) and at least one sliding bar (41). The working bar and the sliding bar are arranged parallel to one another in the bar carrier. The bar type temple has the advantage that the clamping of the web is low without the maintenance of the width of the web being impaired.

21 Claims, 6 Drawing Sheets

SLIDING BAR TEMPLE FOR A POWER LOOM

BACKGROUND OF THE INVENTION

The present invention relates to a bar type temple for a weaving machine.

Bar type temples of the named kind are known from practice as constituents of weaving machines. The purpose of the bar type temple in the weaving machine consists in holding the cloth web manufactured in the weaving machine constant against the forces arising when shooting in weft threads transverse to the warp thread direction. For this the already woven cloth web is in each case clamped at a slight distance from the weft insertion during the shooting in. This clamping is done through a drawing tension under which the warp threads and already woven cloth web are held. Through this drawing tension the cloth web is pressed along two lines against a lower edge and an upper edge of the longitudinal slit in the bar carrier, through which the web is sufficiently firmly clamped in and thus held at its desired width. Since, however, the web must in addition be gradually transported further to the cloth beam in accordance with the progress of the weaving, the clamping must be briefly loosened between two successive shootings in of the weft thread. This loosening of the clamping is done by the beating up of the just shot in weft thread against the end of the already woven web, through which the drawing tension in the web between the beatup and the cloth beam briefly decreases to such an extent that the clamping is decreased in a measure sufficient for a further transport of the web by a distance corresponding to the weft thread thickness.

The above described bar type temple with a single working bar operates thoroughly satisfactorily in dense-weft cloth, i.e. in the manufacture of fabrics with a relatively large number of weft threads per unit length. Problems result, however, when weaving medium-weft and light-weft fabrics, i.e. cloths with low or very low numbers of weft threads per unit length. For low-weft ware in particular situations arise in which the bar jams and an undesirably high drawing tension thereby builds up in the web, which can lead to damage or a lowering of the quality of the cloth. In addition the high tension in the web can lead to loose places in the cloth, with breaks in the warp and weft threads which can no longer be eliminated through subsequent corrections. Furthermore, it can be observed in practice that yarn residues often get wound around the working bar and then lead to visible pressure points in the finished cloth which represent a lowering of the quality. In addition, the irregular running of the bar caused hereby results in periodically arising loose and tight places occurring in the cloth, which is known as the so-called "washboard effect".

SUMMARY OF THE INVENTION

It is therefore the object of the present invention to provide a bar type temple of the initially named kind which avoids the listed disadvantages and which in particular ensures that, in addition to dense-weft ware, medium-weft and low-weft ware can also be manufactured with high quality and with reliable operation. The bar type temple should be of a simple construction and simple and economical to manufacture as well as being flexibly adaptable to different applications and requirements.

With a sliding bar additionally provided in accordance with the invention a situation is achieved in which the web, on entering into the longitudinal slit, is no longer subject to a clamping against the lower edge of the longitudinal slit; a clamping is now present in this embodiment of the bar type temple only in the web passing out through the longitudinal slit. In this manner the clamping forces acting on the web are reduced without the required maintenance of the width of the web being impaired. This embodiment of the bar type temple with only a clamping of the web between the working bar and the longitudinal slit of the bar carrier is suitable in particular for the manufacture of medium-weft ware.

A bar type temple is proposed in particular for the manufacture of light-weft ware in which a second sliding bar is arranged in the bar carrier above the working bar and parallel to it, with the distance of the second sliding bar from the first sliding bar being less than the outer diameter of the working bar, with the working bar lying behind the two sliding bars when seen from the longitudinal slit. In this embodiment of the bar type temple the second clamping of the web is also eliminated, so that now the web is held merely between the working bar at the one side and the two sliding bars at the other side. This also still produces a clamping action which is sufficient for the maintenance of the width of the web; at the same time, however, the cloth is protected in an ideal manner against excessive clamping forces and the risks of a loss of quality associated therewith.

In the above-described embodiments of the bar type temple in accordance with the invention the drawing tension which is exerted on the warp thread arrangement and the web can be significantly reduced; in practice, the reduction can amount to up to about 50. This drawing force reduction also correspondingly lessens the damages or faults in the cloth which arise through or are at least encouraged by excessive drawing forces so that an improved cloth quality and a higher productivity can be achieved in particular in medium-weft and light-weft fabrics with the bar type temple in accordance with the invention. At the same time the bar-type temple can however also be used without restrictions for the manufacture of dense-weft fabrics since the bar carrier of the bar type temple can also be used without a sliding bar, with only a working bar inserted.

Independently of the embodiment of the bar type temple with respect to the number of bars used therein it is proposed that the bar carrier be executed as a housing which is closed with the exception of the longitudinal slit and which can be separated and/or opened for the installation and removal of the working bar and/or of the sliding bar or the sliding bars. A high stability is achieved through this design of the bar carrier, which is a prerequisite for achieving a uniform clamping or braking of the web over the entire width of the web.

A further development of the housing forming the bar carrier consists in that this latter is formed by a one-part or multipart hollow section in which the end faces are covered over by closures, of which at least one can be removed. For the installation and removal of the working bar and of the sliding bar or the sliding bars merely the one end of the bar carrier need be opened, through which its stability is not affected. In addition the bar type temple is considerably more simply accessible from its end in its built-in state in the weaving machine than from the side in which the longitudinal slit is formed.

The hollow section is preferably a folded or angled section of sheet metal in particular for reasons of a simple and economical manufacture of the bar type temple in accordance with the invention.

To achieve a compact construction of the bar type temple and dispense with complicated and expensive means for the positioning and/or the journalling of the bars accommodated therein, it is proposed that, when seen in cross-section, the housing forming the bar carrier is matched in its shape and size to the shape and the number and the diameter of the working and sliding bars to be accommodated therein.

In case the bar type temple is to be used with different numbers and/or sizes of working and sliding bars while maintaining its housing it is advantageous that filler bars for the filling out of bar reception regions which are not taken up by the working and sliding bars can be inserted into the housing forming the bar carrier, in addition to the working and sliding bars.

There is furthermore the possibility in the bar type temple in accordance with the invention for the housing forming the bar carrier to be executed with a plurality of parallel bar reception regions for working and sliding bars which are separate from one another, each with its own longitudinal slit (21, 21'); and for the bar carrier to be connectable in a plurality of different positions to the rest of the weaving machine, with one of the bar reception regions coming into use in each position in each case. In this embodiment the bar carrier can either be varied in its position as a whole in order to bring a selected bar reception region into use, or the housing can be reassembled, in particular through the displacement of housing parts, in such a manner that a desired bar reception region comes into use. In this way a particularly wide adaptability of the bar type temple to different applications is made possible without it being necessary to keep a plurality of different bar type temples available.

For using weaving machines with as much versatility as possible, i.e. for the manufacture of the most diverse fabrics in particular, weaving machines as a rule have, among other things, apparatuses for the adjustment of the height of the bottom shed. The bar type temple in accordance with the invention can in addition advantageously be used in this function in that sliding bars of different diameters can be inserted into the bar carrier. By changing the first sliding bar, which lies in the lower part of the bar type temple, the bottom shed height is also changed in accordance with the change of the diameter of the sliding bar as long as the web does not come into contact with the lower edge of the longitudinal slit in the bar carrier lying ahead of the first sliding bar. Through a choice of the width of the longitudinal slit in accordance with the use, a range of variation for the bottom shed height which is sufficient in practice can be ensured; for example an adjustment range of about 6 mm is sufficient for most applications.

For keeping the bar type temple as simple and hence as economical as possible, it is proposed that all working and sliding bars lie loosely in the bar carrier. The arrangement of the working and sliding bars relative to one another is determined by the sequence of the installation and by the forces exerted by the web on the working bar as well as the contour of the bar carrier. As long as the tension is maintained in the web, the relative arrangement of the bars with respect to one another can also not change in an undesirable manner. If it is not ensured that the tension is constantly maintained, filler bars can, as already mentioned above, be additionally installed in the bar carrier, with these filler bars expediently also lying loosely in the bar carrier. The working and sliding bars must have a round cross-section as a result of the function intended for them; the contours of the filler bars can be chosen in practically any manner desired and need only fill out the space to be filled by them as well as possible.

An alternative embodiment to the last described bar type temple provides that, when seen from the longitudinal slit, a firmly installed filler body is arranged behind the working and sliding bars, with the side of the filler body facing the bars being matched or approximated to their contour while keeping a passageway for the cloth free. This embodiment of the bar type temple can be meaningfully used, in particular when a uniform cloth type is to be predominantly manufactured with the associated weaving machine, which means that exchanging the working and sliding bars does not arise or arises only seldom. The firmly installed filler body can, at the same time, take over the function of a spacer which maintains a spacing between two sections which are arranged parallel to one another for the formation of the bar type temple. The connection between the sections and the filler body is then expediently realized by releasable connection means, e.g. screws.

For the protection of the web, which passes into and out of the bar type temple, it is further also proposed that the lower edge and/or the upper edge of the longitudinal slit/the longitudinal slits is/are rounded off, at least at the outer sides.

DESCRIPTION OF THE PREFERRED EMBODIMENTS

Figure 1:
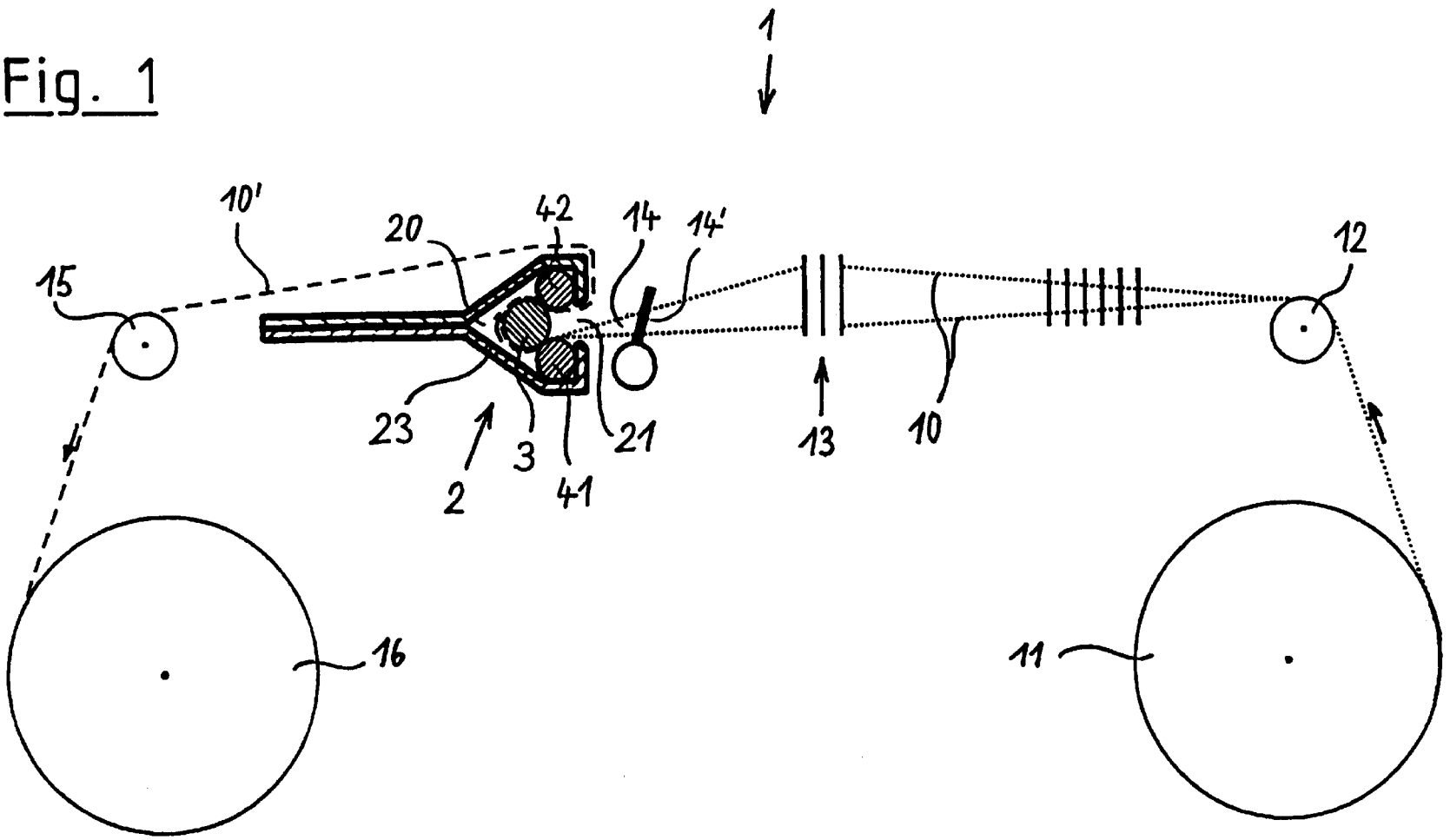
FIG. 1 is a highly abstracted schematic illustration of a weaving machine in a side view, partly in a cross-section.

In accordance with FIG. 1 of the drawings the illustrated embodiment of a weaving machine 1, which is only schematically shown, comprises a warp let-off 11, from which warp threads 10 are supplied via a deflection drum 12 to a shed former 13. The shed former 13 is followed, towards the left in the drawing, by a weft insertion arrangement 14 with a weft beat-up device 14'. In this region weft threads are shot into sheds which are formed between the upper and the lower weft threads 10 by means of a shuttle which is moved perpendicular to the plane of the drawing. This shuttle is not illustrated because it is generally known. The weft beat-up device 14' beats up the newly shot in weft threads against the end of the already woven cloth web 10'.

The weft insertion arrangement 14 and the weft beat-up device 14' are immediately followed by a bar type temple 2, which is illustrated in an exaggerated large manner in the present drawing to clarify its function. The bar type temple 2 ensures that the width of the web 10' is maintained against the forces which are exerted on the weft threads 10 when the weft thread is shot into the weft insertion 14 in the transverse direction of the web 10'. For this purpose the web is in each case sufficiently clamped inside the bar type temple 2 during the shooting extent and its width is thus maintained. For the production of this clamping action, an arrangement of a total of three bars 3, 41, 42 is provided in the bar type temple 2 which is drawn in FIG. 1, of which the bar 3 is a working bar and the bars 41, 42 are sliding bars. For the accommodation of the bars 3, 41, 42, the bar type temple 2 has a bar carrier 23 which is made in the form of a housing which is closed with the exception of a frontal longitudinal slit 21. In the interior of the bar carrier 23 a reception region 20 is formed in which the mentioned bars 3, 41, 42 are arranged. The bar 41 is arranged in the lower part of the bar carrier 23 as a first sliding bar; the bar 42 is arranged in the upper part of the bar carrier 23 as a second sliding bar, with both bars 41, 42 extending parallel to one another in the longitudinal direction of the reception region 20 of the bar type temple 2. When seen from the longitudinal slit 21 the working bar 3 lies behind the first and second sliding bar 41, 42, with the web 10 coming from the weft insertion arrangement 14 first passing into the bar carrier 23 through the longitudinal slit 21, then between the first sliding bar 41 and the working bar 3, wrapping around the working bar 3 by an angle of more than 180°; and then being led through between the working bar 3 and the second sliding bar 42 and then back out of the bar type temple 2 through the longitudinal slit 21. Following this, the finished woven web 10' arrives at the cloth take-up 16 via a further deflection drum 15. Both the cloth take-up 16 and the warp let-off 11 are designed as drums, with it being expedient for the cloth take-up 16 to be rotationally drivable in order to be able to exert a predetermined or predeterminable drawing force on the web 10'. At the same time the warp let-off 11 is formed with an adjustable brake device in order to be able to regulate the tensile force exerted on the warp threads 10 from here as well.

In the illustrated exemplary embodiment the mentioned tensile forces ensure that the web 10' and the warp threads 10 cannot move in the transport direction (indicated by arrows) during the shooting in of a weft thread, because a clamping between the working bar 3 at the one side and the two sliding bars 41, 42 on the other side results. This clamping is briefly removed or at least diminished at each beating up of the weft beat-up 14' device so that then a respective and adequate further transport of the web 10' and of the warp threads 10 in the transport direction is possible. Since the clamping of the web takes place only between the cylindrical peripheral surfaces of the working bar 3 and of the sliding bars 41, 42, the web 10' is treated very protectively, with this embodiment of the bar type temple 2 being particularly suitable for the manufacture of light-weft fabrics.

Figure 2A:
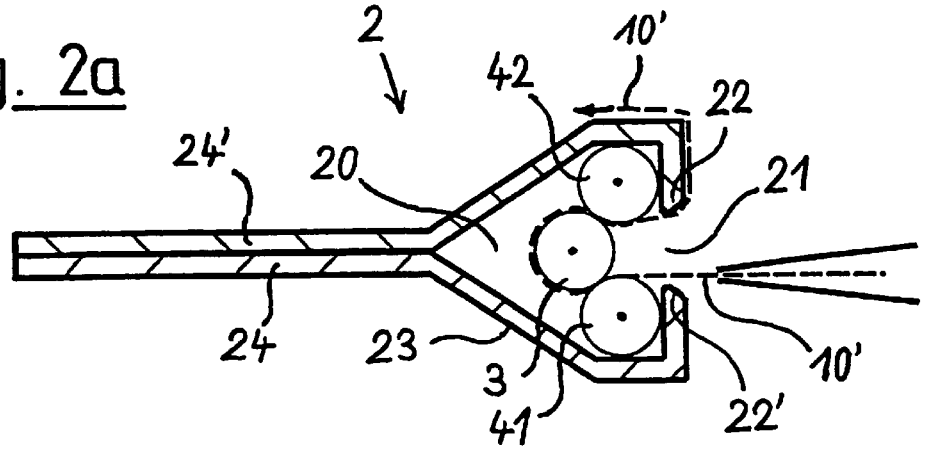
FIGS. 2*a* and 2*b* show embodiments of the bar type temple forming a part of the weaving machine of FIG. 1 with a working bar and two sliding bars.

FIG. 2*a* of the drawings shows the bar type temple 2 of FIG. 1, likewise in cross-section, in an enlarged representation, with the number and arrangement of the bars 3, 41, 42 being identical to that in FIG. 1. The bar carrier 23 consists of two section parts 24, 24' which are manufactured by folding, which are identical to one another, and which are arranged with mirror symmetry with respect to one another and combined to form the bar carrier 23.

Figure 2B:
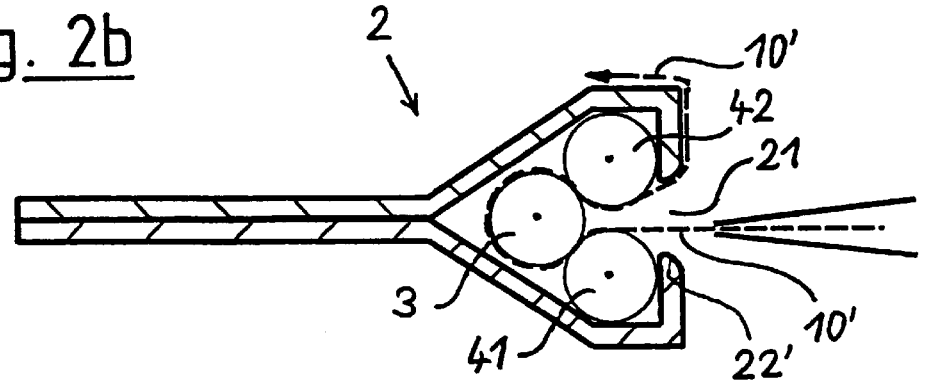

FIG. 2*b* now shows the bar type temple 2 in an embodiment in which bars 3, 41, 42 with diameters are used which deviate upwardly from those of the bars 3, 41, 42 of FIG. 2*a*. The clamping function is not changed by this; what does change, however, is the bottom shed height of the web 10' entering into the bar type temple 2. As is made clear by a comparison of FIGS. 2*a* and 2*b*, the web 10' in FIG. 2*a* enters into the bar type temple 2 at a relatively small distance above the lower edge 22' of the longitudinal slit 21 whereas the web 10' in FIG. 2*b* enters into the longitudinal slit 21 at a correspondingly greater distance from its lower edge 22' as a result of the use of a sliding bar 41 with a larger diameter. In this way the associated weaving machine no longer requires special means for the adjustment of the bottom shed height.

Figure 3A:
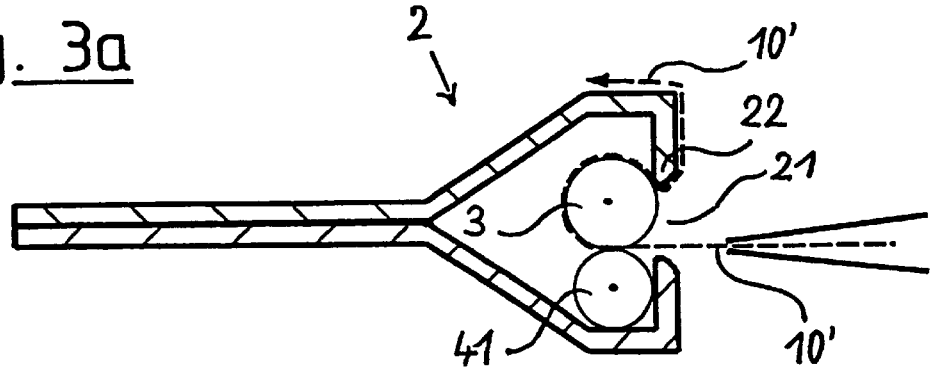
FIGS. 3*a* and 3*b* show an embodiment of the bar type temple with one working bar and one sliding bar each.
Figure 3B:
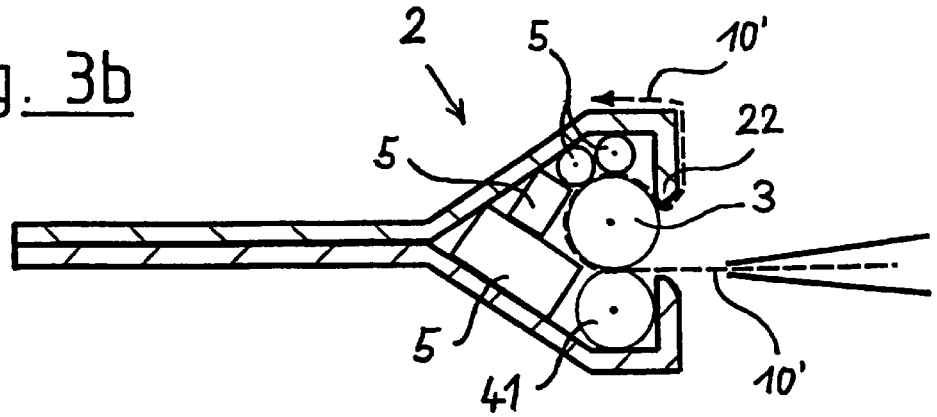

FIGS. 3*a* and 3*b* show an embodiment of the bar type temple 2 which is particularly suitable for the manufacture of medium-weft ware. In this embodiment the second sliding bar 42 is not used; only the working bar 3 together with the first sliding bar 41 are used. In contrast to the preceding embodiments, a clamping between the working bar 3 and the upper edge of the longitudinal slit 21 is effected when the web 10' passes out of the bar type temple 2. A net clamping action of a medium strength thus results, whereby the preferred use for medium-weft ware is achieved.

To ensure the desired position of the working bar 3 and the sliding bar 41, additional filler bars 5 can be arranged, as shown in FIG. 3, in suitable shape and number in the bar carrier 23 in addition to the named bars, which precludes a deviation of the working bar 3*b* and of the sliding bar 41 from the desired position.

Figure 4:
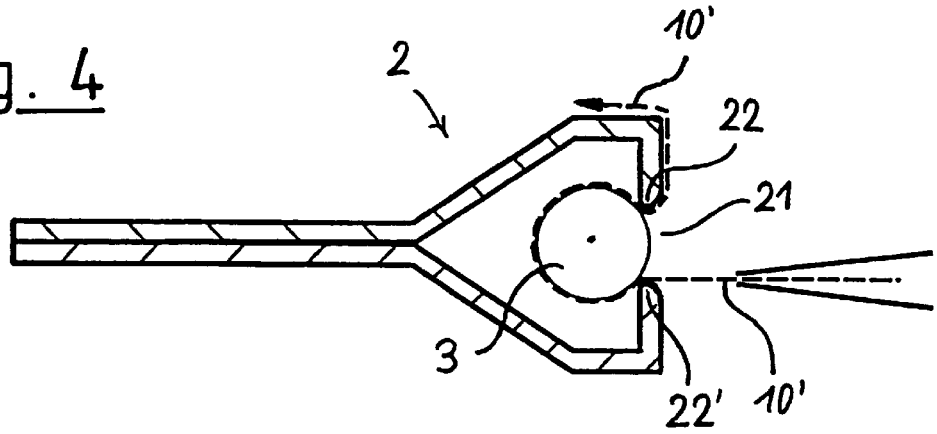
FIG. 4 shows a bar type temple in an embodiment having only one working bar.

FIG. 4 of the drawings shows an embodiment of the bar type temple 2 which uses only a single working bar 3 without sliding bars. As can be clearly seen in the drawing, a clamping of the web 10' takes place both on entry into the bar type temple 2 as well as on leaving it between the working bar 3 on the one side and the lower as well as the upper edge 22', 22 of the longitudinal slit 21. A particularly strong net clamping action is thereby achieved, which makes this embodiment of the bar type temple 2 particularly suitable for dense-weft ware.

As a comparison of FIGS. 2*a* to 4 makes clear, the bar carrier 23 is in each case completely unchanged, which illustrates the flexibility of the bar type temple 2, which is achieved solely through the choice of different bars or of more or fewer bars 3, 41, 42.

Figure 5A:
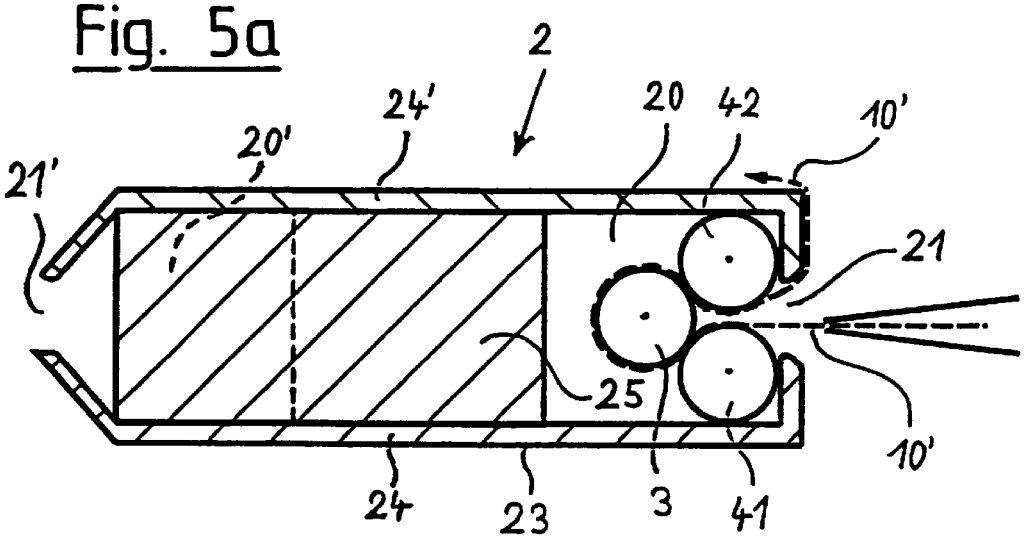
FIGS. 5*a* and 5*b* show a bar type temple with a working bar and two sliding bars with a bar carrier which can be used in different positions.
Figure 5B:
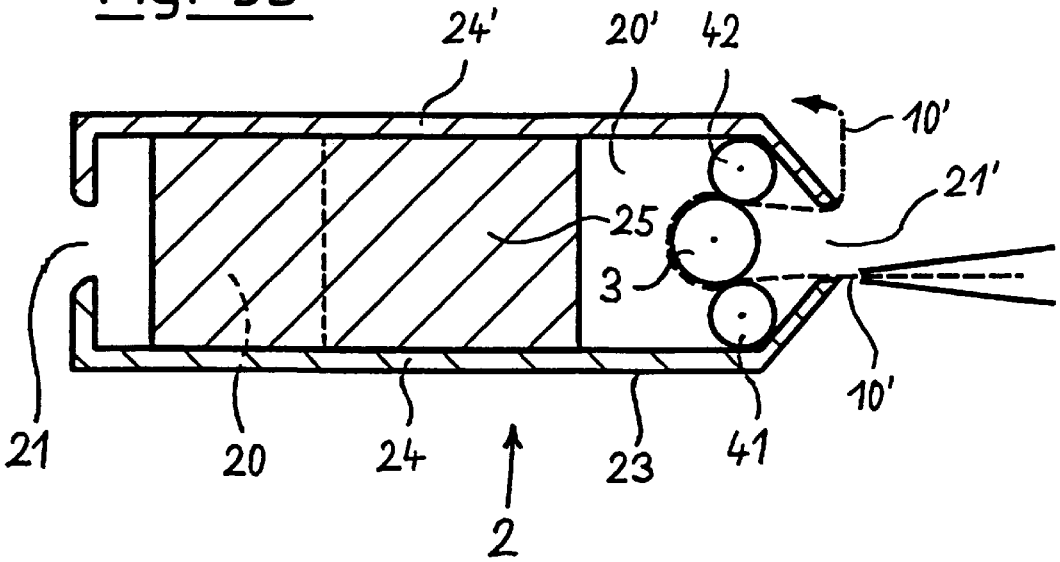

FIGS. 5*a* and 5*b*, finally, show an embodiment of the bar type temple 2 with a bar carrier 23 which can be used in different positions and with which different properties of the bar type temple 2 can thus be realized.

The bar type temple 2 made in accordance with FIG. 5*a* and FIG. 5*b* consists first of two section parts 24, 24' which are arranged with mirror symmetry with respect to one another and between which a spacer 25 of rectangular cross-section is arranged.

The section parts 24, 24' each have a substantially inwardly directed, right angled portion at their edge which lies on the right in FIG. 5*a*, with the right angled portions bounding the longitudinal slit 21. The web 10' passes in through this longitudinal slit 21, as already described above, e.g. with reference to FIGS. 2*a* and 2*b*, and, after wrapping around the working bar 3, also back out again.

In the arrangement of the bar type temple 2 in accordance with FIG. 5*b* the two section parts 24, 24' are connected to the spacer 25 in a reversed position, through which the right angled portions now lie on the left and the less angled portions, which previously lay there, now point to the right. A longitudinal slit 21' through which the web 10' passes is also bounded by the less angled portions. As a result of the now different form of the parts of the bar type temple 2 bounding the longitudinal slit 21', the latter receives different properties, through which an adaptation to different uses is enabled.

Finally, a smaller embodiment of the spacer 25, which in this embodiment lies symmetrically between the left and right longitudinal sides of the bar type temple 2, is indicated in FIGS. 5*a* and 5*b* by a broken line. In this embodiment a respective reception region 20, 20' is permanently present at each longitudinal side of the bar type temple 2 so that for a change of the property of the bar type temple 2 the latter need only be reversed in its entirety. A replacement of the working bar 3 and of the sliding bars 41, 42 is also possible without further ado in the embodiment of the bar type temple 2 in accordance with FIGS. 5*a* and 5*b*. Thus, an adjustment of the bottom shed height and a change of the clamping action for the adaptation to different cloth types can be effected.

Figure 6:
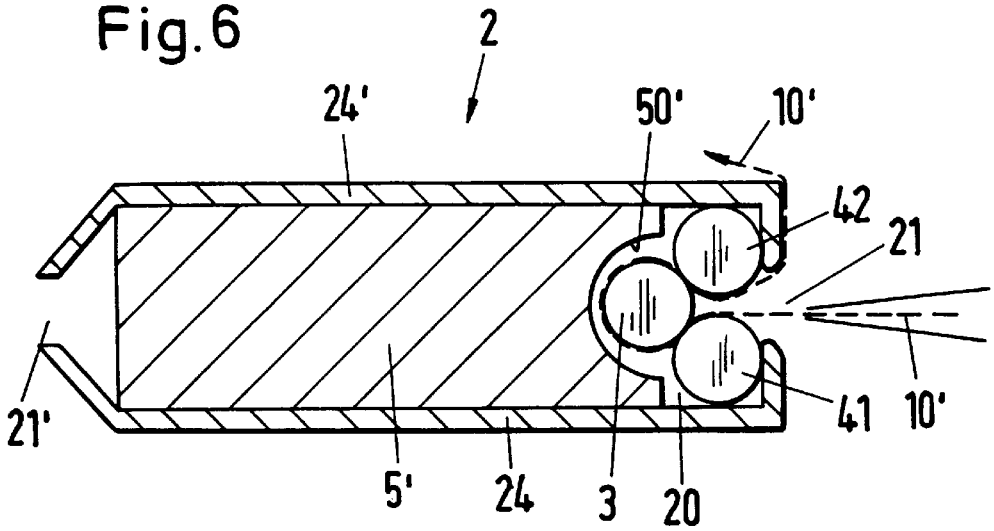
FIG. 6 shows a bar type temple with a working bar and two sliding bars and with a firmly installed filler body.
Figure 7A:
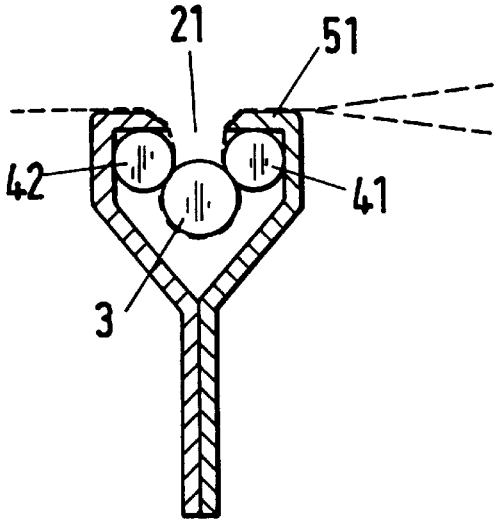
FIG. 7 shows an embodiment of a bar type temple with a cloth support.
Figure 7B:
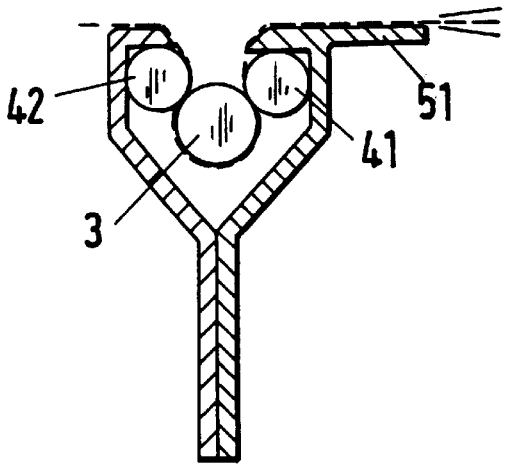
Figure 7C:
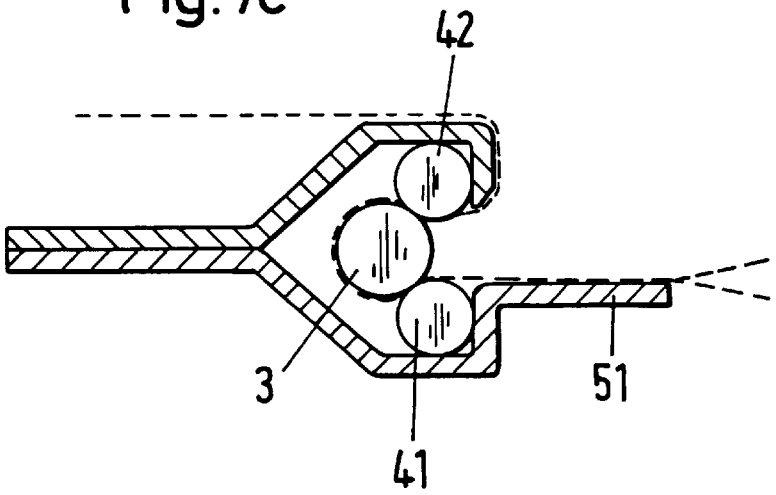
Figure 7D:
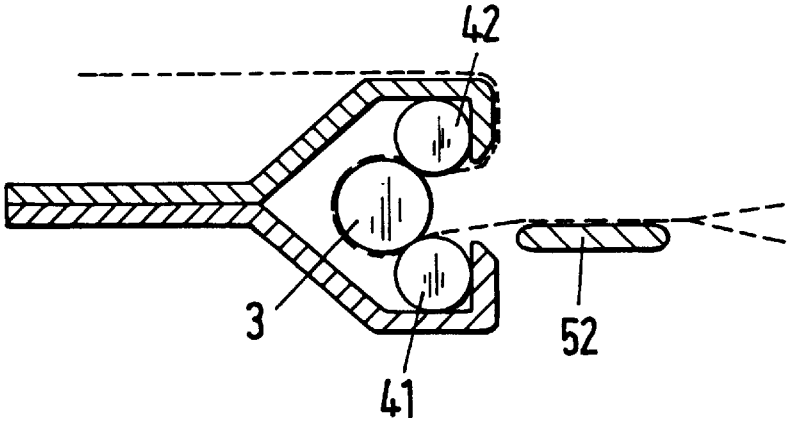
Figure 7E:
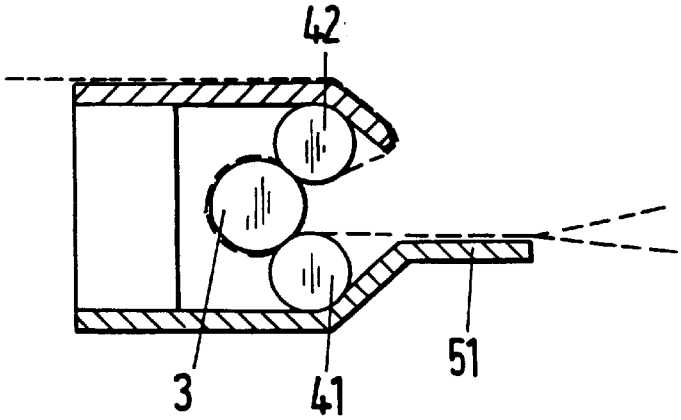

FIG. 6 of the drawings shows an embodiment of the bar type temple 2 in which, similarly as in FIG. 5*a* and FIG. 5*b*, two section parts 24, 24' are arranged with mirror symmetry with respect to one another and longitudinal slits 21, 21' at their longitudinal sides. In order to hold the two section parts 24, 24' at the correct distance from one another and to connect them at this distance, a firmly installed filler body 5' is provided between them. In addition to its function as a spacer and a connection link for the section parts 24, 24', this firmly installed filler body 5' at the same time replaces the loose filler bars 5 described above with reference to the exemplary embodiment in accordance with FIG. 3*b*. In order to be able to assume this function, the side 50' of the filler body 5' near the working and sliding bars 3, 41, 42 is matched or at least approximated in its contour to the arrangement of the bars 3, 41, 42. In this arrangement, however, there always remains sufficient free space between the side 50' of the filler body 5' and the peripheral surfaces of the bars 3, 41, 42 for an unhindered passage of the cloth web 10'.

The arrangement and function of the working bar 3 and of the sliding bars 41, 42 corresponds to that of the exemplary embodiments in accordance with FIGS. 2*a*, 2*b* and 5*a*. It is self-evident that a modification of the number and arrangement of the bars 3, 41, 42 is possible in the bar type temple 2 in accordance with FIG. 6 without further ado. The use of the bar type temple 2 in accordance with FIG. 6 is however always expedient when it can be expected that the arrangement and size of the bars 3, 41, 42 to be used will remain constant. When required, however, an adaptation to different numbers and arrangements of the bars 3, 41, 42 can be made here as well through replacement of the fixedly installed filler body 5'. At the same time, in the bar type temple 2 in accordance with FIG. 6, there is also the possibility of using it in the reversed position, as has already been explained with reference to FIGS. 5*a* and 5*b*.

FIGS. 7*a* to 7*e* show embodiments of bar type temples with a cloth support 51, 52, with the number and arrangement of the bars 3, 41, 42 corresponding to that in FIG. 2*a*. In the embodiment in accordance with FIG. 7*a* the bar type temple is arranged in such a manner that a housing section serves as a cloth support. In the embodiments in accordance with FIGS. 7*c* and 7*e* the cloth support 51 is formed as a single piece with the section part 24. In the embodiment in accordance with FIG. 7*d* the cloth support 51 is formed as a separate part. It is pointed out that the angular position of the cloth support can be predetermined with respect to the longitudinal slit 21.

Figure 8A:
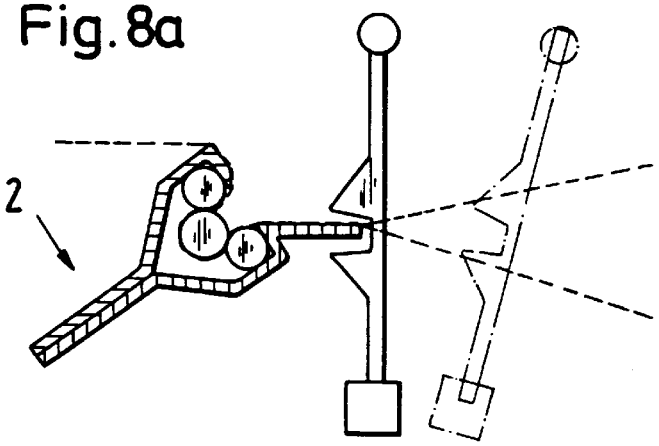
FIGS. 8*a* to 8*c* show the use of the bar type temple in different weaving machines.
Figure 8B:
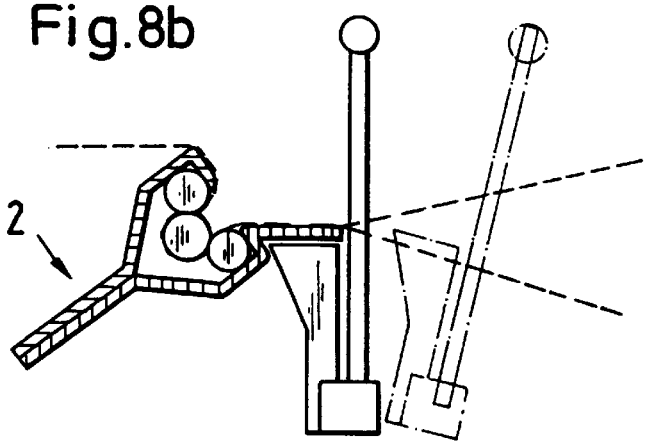
Figure 8C:
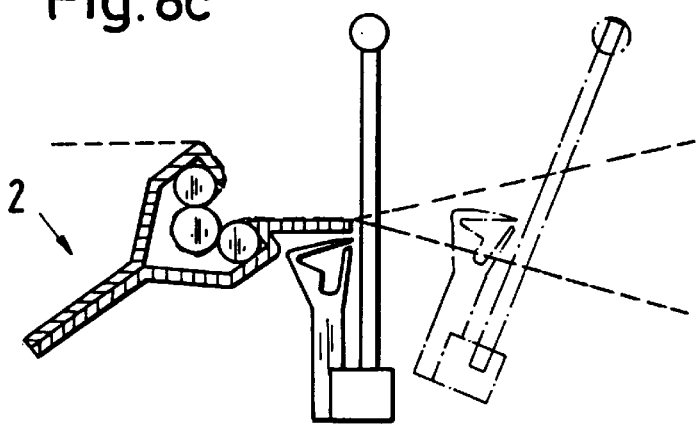

FIGS. 8*a* to 8*c* show a cloth support of this kind in an air jet weaving machine (FIG. 8*a*), in a rapier weaving machine (FIG. 8*b*) and in a projectile weaving machine (FIG. 8*c*).

The bar type temple 2 consists substantially of a bar carrier 23, a working bar 3 and at least one sliding bar 41. The working bar and the sliding bar are arranged parallel to one another in the bar carrier.

The bar type temple has the advantage that the clamping of the web is low without the maintenance of the width of the web being impaired.

What is claimed is:

1. Bar type temple for weaving machine for weaving a fabric web having a width and subjected to longitudinal tension in a direction of movement of the fabric web during weaving, the bar type temple comprising a bar carrier having an interior space and at least one slit permitting passage of the fabric web while under tension into and out of the interior space of the carrier, a working bar arranged in the interior space of the bar carrier about which the fabric web wraps through an angle greater than 180° when the fabric web passes through the interior space, and at least one sliding bar arranged in the interior space parallel to the working bar.

2. Bar type temple according to claim 1 wherein the slit is defined by a lower edge, and wherein the sliding bar includes an outer periphery and is arranged beneath the working bar, the fabric web engaging the outer periphery upon entering the interior space through the slit, a portion of the outer periphery first contacted by the fabric web being at a height above a height of the lower edge of the longitudinal slit.

3. Bar type temple according to claim 1 including a second sliding bar arranged in the interior space of the bar carrier parallel to and above the working bar, a distance between the first-mentioned sliding bar and the second sliding bar being less than an outer diameter of the working bar, the sliding bars being located relatively closer to the slit than the working bar.

4. Bar type temple according to claim 1 including a cloth support made in one piece with the bar carrier.

5. Bar type temple according to claim 1 including a cloth support positioned upstream of the slit in the direction of movement of the fabric web towards the slit.

6. Bar type temple according to claim 1 wherein the bar carrier defines a housing that is closed to an exterior thereof except for the slit therein, the housing being adapted to be opened for installing and removing at least one of the working bar and the sliding bar.

7. Bar type temple according to claim 6 wherein the housing is formed by a hollow section and has ends which are covered with closures, at least one of the closures being removable.

8. Bar type temple according to claim 7 wherein the hollow section comprises a folded section of sheet metal.

9. Bar type temple according to claim 6 wherein the housing defines the interior space and, in cross-section, has a shape and size matched to a shape, a number, and a diameter of the working and sliding bar positioned therein.

10. Bar type temple according to claim 7 wherein the interior space, in cross-section, is larger than a cross-section of the working bar and the sliding bar, and including filler bars inserted into the interior space for filling regions thereof not occupied by the working bar and the sliding bar.

11. Bar type temple according to claim 7 wherein the interior space defined by the housing includes a plurality of bar reception regions for the insertion of the working bar and the sliding bar at different relative locations inside the interior space, the housing including a slit for each of the bar reception regions, the housing being adapted to be combined with the weaving machine in a plurality of different relative positions, each of the different relative positions placing the working bar and the sliding bar in an operative position on the weaving machine.

12. Bar type temple according to claim 1 wherein the interior space is adapted for accommodating sliding bars of differing diameters for adjusting a height of a bottom shed formed by the weaving machine.

13. Bar type temple according to claim 1 wherein the working bar and the sliding bar are floatingly arranged in the interior space of the bar carrier.

14. Bar type temple according to claim 1 wherein the bar carrier includes a filler bar disposed on a side of the working bar and the sliding bar opposite from the slit, a side of the filler bar facing the working bar and the sliding bar having a shape at least approximately corresponding to a peripheral contour of the sliding bar and the working bar and positioned relative thereto to permit free passage of the fabric web between them.

15. Bar type temple according to claim 1 wherein the slit is defined by opposing upper and lower slit edges, and wherein at least a portion of at least one of the slit edges proximate an outer side of the bar carrier is rounded.

16. Weaving apparatus for weaving a fabric web having a width and subjected to longitudinal tension in a direction of movement of the web during weaving, the apparatus comprising a weaving machine selected from the group consisting of an air jet weaving machine, a rapier weaving machine, and a projectile weaving machine; a bar carrier having an interior space and at least one slit permitting passage of the fabric web while under tension passes into and out of the interior space of the carrier; a working bar arranged in the interior space of the bar carrier about which the fabric web wraps through an angle greater than 180° when the fabric web passes through the interior space; and at least one sliding bar arranged in the interior space parallel to the working bar.

17. Bar type temple for weaving machine for weaving a fabric web having a width and subjected to longitudinal tension in a direction of movement of the fabric web during weaving, the bar type temple comprising a bar carrier having an interior space and a slit through which the fabric web while under tension passes into and out of the interior space of the carrier, a working bar arranged in the interior space of the bar carrier which is engaged by the fabric web when it passes through the interior space, and at least one sliding bar arranged in the interior space parallel to the working bar, the sliding bar having an outer periphery and being arranged beneath the working bar, the fabric web engaging the outer periphery upon entering the interior space through the slit, a portion of the outer periphery first contacted by the fabric web being at a height above a height of the lower edge of the longitudinal slit.

18. Bar type temple for weaving machine for weaving a fabric web having a width and subjected to longitudinal tension in a direction of movement of the fabric web during weaving, the bar type temple comprising a bar carrier having an interior space and a slit through which the fabric web while under tension passes into and out of the interior space of the carrier, a working bar arranged in the interior space of the bar carrier which is engaged by the fabric web when it passes through the interior space, a first sliding bar arranged in the interior space parallel to the working bar, and a second sliding bar arranged in the interior space of the bar carrier parallel to and above the working bar, a distance between the first and second sliding bars being less than an outer diameter of the working bar, the first and second sliding bars being located relatively closer to the slit than the working bar.

19. Bar type temple for weaving machine for weaving a fabric web having a width and subjected to longitudinal tension in a direction of movement of the fabric web during weaving, the bar type temple comprising a bar carrier having an interior space and a slit through which the fabric web while under tension passes into and out of the interior space of the carrier, a working bar arranged in the interior space of the bar carrier which is engaged by the fabric web when it passes through the interior space, and at least one sliding bar arranged in the interior space parallel to the working bar, the bar carrier defining a housing that is closed to an exterior thereof except for the slit therein, the housing being adapted to be opened for installing and removing at least one of the working bar and the sliding bar.

20. Bar type temple for weaving machine for weaving a fabric web having a width and subjected to longitudinal tension in a direction of movement of the fabric web during weaving, the bar type temple comprising a bar carrier having an interior space and a slit through which the fabric web while under tension passes into and out of the interior space of the carrier, a working bar arranged in the interior space of the bar carrier which is engaged by the fabric web when it passes through the interior space, and at least one sliding bar arranged in the interior space parallel to the working bar, the working bar and the sliding bar being floatingly arranged in the interior space of the bar carrier.

21. Bar type temple for weaving machine for weaving a fabric web having a width and subjected to longitudinal tension in a direction of movement of the fabric web during weaving, the bar type temple comprising a bar carrier having an interior space and a slit through which the fabric web while under tension passes into and out of the interior space of the carrier, a working bar arranged in the interior space of the bar carrier which is engaged by the fabric web when it passes through the interior space, at least one sliding bar arranged in the interior space parallel to the working bar, and a filler bar disposed on a side of the working bar and the sliding bar opposite from the slit, a side of the filler bar facing the working bar and the sliding bar having a shape at least approximately corresponding to a peripheral contour of the sliding bar and the working bar and positioned relative thereto to permit free passage of the fabric web between them.

* * * * *